US005692282A

United States Patent [19]

Baca

[11] Patent Number: 5,692,282

[45] Date of Patent: Dec. 2, 1997

[54] SEAL PULLER

[76] Inventor: Frank M. Baca, 6120 24th St., Lubbock, Tex. 79407

[21] Appl. No.: 577,552

[22] Filed: Dec. 22, 1995

[51] Int. Cl.[6] ..... B25B 27/02

[52] U.S. Cl. ..... 29/235; 29/259; 29/264

[58] Field of Search ..... 29/259, 235, 256, 29/258, 263, 282; 81/8.1

[56] References Cited

U.S. PATENT DOCUMENTS

| | | | |
|---|---|---|---|
| 1,599,340 | 9/1926 | Malone | 29/259 |
| 1,607,592 | 11/1926 | Marciano et al. | 29/259 |
| 3,078,556 | 2/1963 | Carroll | 29/259 |
| 3,200,483 | 8/1965 | Menegoni | 29/259 |
| 3,340,593 | 9/1967 | Savastano . | |
| 3,564,696 | 2/1971 | Shepanski | 29/256 |
| 3,611,540 | 10/1971 | Gibu . | |
| 3,651,557 | 3/1972 | Bagley . | |
| 3,902,236 | 9/1975 | Deem | 29/259 |
| 3,909,916 | 10/1975 | Neff et al. | 29/235 |
| 4,211,446 | 7/1980 | Shulz, Sr. . | |
| 4,426,758 | 1/1984 | Castoe . | |
| 4,982,493 | 1/1991 | Wendt | 29/264 |

*Primary Examiner*—Robert C. Watson
*Attorney, Agent, or Firm*—Stephen R. Greiner

[57] ABSTRACT

A seal puller for removing worn seals from transmissions and like equipment. The seal puller includes a planar body having opposed top and bottom surfaces and a threaded transverse bore. A plurality are positioned adjacent the transverse bore. A bolt is threadably secured within the transverse bore. The bolt has a threaded rod portion which may be projected from the transverse bore beneath the bottom surface of the body.

4 Claims, 1 Drawing Sheet

SEAL PULLER

FIELD OF THE INVENTION

The present invention relates generally to implements for applying pushing and pulling force.

BACKGROUND OF THE INVENTION

Motorized vehicles have long been used to move goods and equipment with minimal effort about warehouses and other storage facilities. Barrett Industrial Trucks, Inc., of Marengo, Ill., has been a leader in the development of such vehicles, affectionately referred to as "tuggers" by those who utilize them. Unfortunately, however, the performance of routine maintenance upon Barrett tuggers to keep them working at peak efficiency has never been particularly easy due to their relative complexity and compact size.

One problem which often arises during maintenance operations involves the replacement of the drive axle oil seal. The service manual accompanying the SG 1 24 DF model tugger, for instance, recommends that a standard screwdriver be utilized to wrest the oil seal from its seat. A service technician, it is suggested, should insert the end of the screwdriver under the seal lip and use the transmission housing as a fulcrum to pry the seal loose. This operation is extremely difficult to perform in the confined spaces surrounding the transmission and typically results in the formation of undesirable scratches on the seal seat. Prior to installing a new seal, a fine emery cloth or stone must be used to remove these scratches. Needless to say, much time is lost repairing the minor damage to the transmission caused by removal of the seal in the recommended fashion.

After the scratches have been polished away, seal replacement can typically be accomplished in a straightforward manner. First, the outer edge of the new seal is coated with liquid gasket cement to ensure against leaks. The open side of the seal is then packed with grease and the seal is positioned over the drive axle. The seal is next carefully tapped into the seat provided therefor in the transmission housing. A properly installed seal will seat substantially flush with the outside of the transmission housing.

SUMMARY OF THE INVENTION

In light of the problems encountered in removing oil seals such as those found in Barrett tuggers, it is a principal object of the present invention to provide a seal puller which can be used to rapidly remove seals of different sizes from confined areas in a variety of equipment without harm to the equipment itself.

It is another object of the invention to provide a seal puller which is durable and not subject to erosion or degradation in oily environments.

It is a further object of the invention to provide a seal puller which may be readily grasped in the hands of user even when the seal puller is coated with oil or grease.

It is an object of the invention to provide improved elements, and arrangements thereof, in a seal puller which is lightweight, inexpensive, dependable and fully effective in accomplishing its intended purposes.

Briefly, the seal puller in accordance with the present invention achieves the intended objects by featuring a planar body having opposed top and bottom surfaces and a threaded transverse bore connecting the top and bottom surfaces. Adjacent the transverse bore, a plurality of elongated slots connect the top and bottom surfaces of the planar body. In each of the elongated slots is positioned a screw having a gimlet point which may be rotated by a user to attach the seal puller to a seal. A bolt, threadably secured within the transverse bore, may be rotated by a user to drive the body of the seal puller from a supporting surface, like the drive axle extending from a Barrett tugger transmission, to extract the attached seal from its seat.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 2:
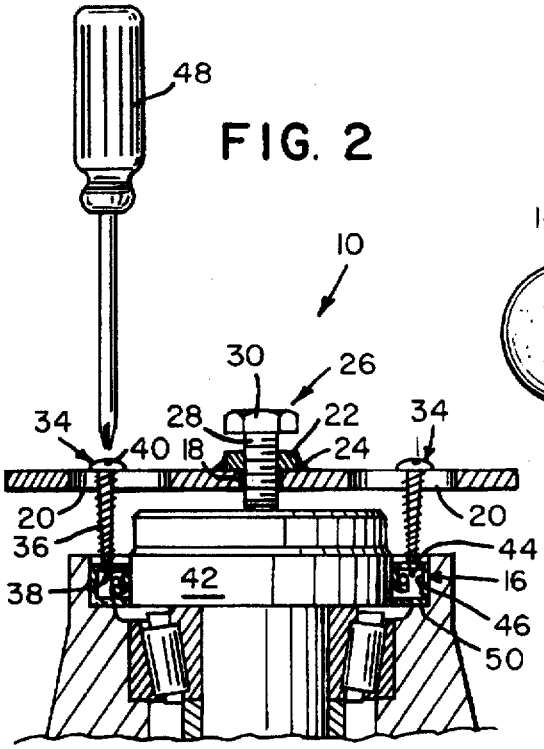
FIG. 2 is a cross-sectional view of the seal puller of FIG. 1 positioned to remove an oil seal from a transmission assembly.
Figure 1:
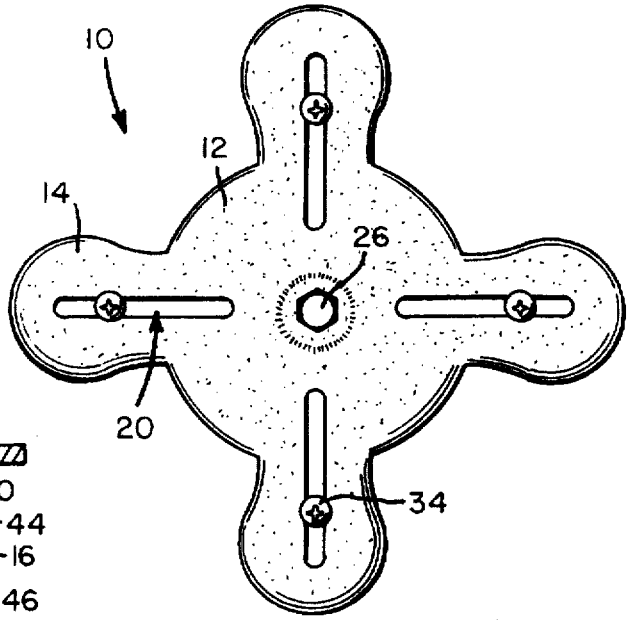
FIG. 1 is a top view of a seal puller in accordance with the present invention.
Figure 3:
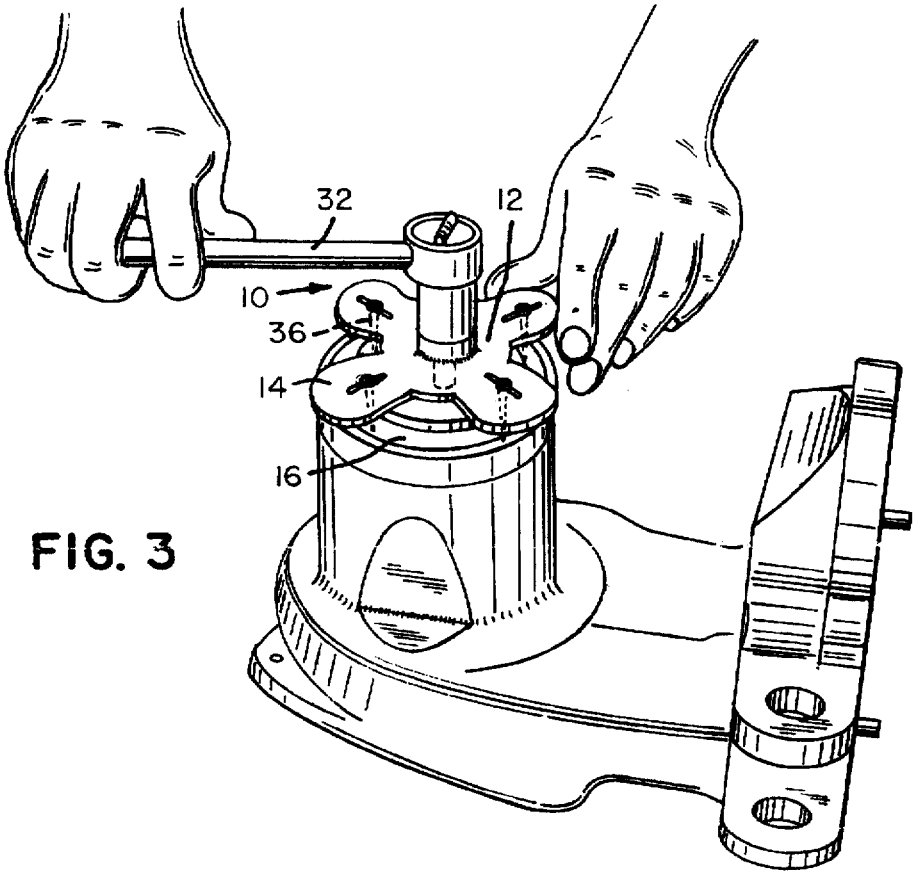
FIG. 3 is a perspective view of the seal puller on the transmission assembly, a ratchet-type wrench being engaged with the lifting bolt.

Referring now to FIGS., a seal puller in accordance with the present invention is illustrated generally at 10. As shown, the seal puller 10 includes a generally circular body 12 having a plurality of integral arms 14 extending radially outward from the periphery of the body 12. The diameter of the body 12 is preferably sized to be substantially equivalent to that of the oil seal 16 being replaced and, thus, shields a user from contact with any oil or grease which may be carried by the seal 16 during use of the seal puller 10. The arms 14, on the other hand, preferably have a length which may be readily grasped by the fingers of a user and are provided with an ovoid outline to enhance their handling characteristics. For increased durability and strength, the body 12 and arms 14 are preferably cut as a single unit from a rigid, flat, metallic plate.

The body 12 and arms 14 include a number of openings through their respective surfaces. The center of the body 12 is provided with a transverse bore 18 connecting its top and bottom surfaces. Equidistantly positioned about the transverse bore 18 are a plurality of elongated apertures or slots 20. As shown, each slot 20 extends radially outward from the body 12 and partially into an arm 14. Each slot 20 also extends along the central, longitudinal axis of a corresponding arm and preferably has a width that is less than twenty percent of that of the arm at its narrowest location.

A hexagonal nut 22 is secured by a weld 24 to the top surface of the body 12 so that the central axis of the nut corresponds with the central axis of the transverse bore 18. A bolt 26 is threadably secured to the nut 22. As shown, the threaded rod portion 28 of the bolt 26 is sized to extend through the transverse bore 18 and outwardly from the bottom surface of the body 12. The head 30 of the bolt 26 may, of course, be rotated by a conventional ratchet wrench 32 or like device to vary the length of the extension of the threaded rod portion 28 from the bottom surface of the body 12.

Fitted for axial movement within each of the slots 20 is a penetrating-type screw 34. As shown, each screw 34 includes a threaded shaft 36 that is sized to extend through a slot 20 and beneath the body 12 or arm 14 (depending upon the relative positioning of the screw 34 along the length of the slot). The threaded shaft 36 includes a gimlet point 38 at its free end to assist the screw 34 in penetrating the oil seal 16 in a manner which will be described more fully hereinbelow. The head 40 of the screw 34 has a diameter greater than the width of the slot 20 and is, thus, retained against the top surface of the seal puller 10 during use.

To use the seal puller 10 to remove a worn oil seal 16, the drive wheel (not shown) must first be removed from the drive axle 42. Next, the body 12 of the puller 10 is positioned adjacent the worn oil seal 16. Using the seal puller 10 as a template, the locations of a plurality of small holes to be made in the worn seal 16 are marked at the intersections of the slots 20 and the adjacent seal 16. Holes 44 are provided in the worn seal 16 by drilling with a standard power drill or punching with a sharpened awl. As shown, the holes 44 only penetrate the metallic outer flange 46 of the oil seal 16 and have a diameter sufficiently large to permit the gimlet points 38 of the screws 34 to penetrate the seal 16 and become securely affixed thereto.

Once each of the screws 34 have been secured to the worn seal 16 by rotation of the screwdriver 48, the bolt 26 may be rotated by a ratchet wrench 32 to drive the threaded rod portion 28 against the end of the drive axle 42 and lift the seal evenly from its seat 50. The worn seal 16 may be discarded and replaced with a new seal in the usual fashion. Although the preferred seal puller 10 is sized to best accommodate a seal 16 having a 4 inch (10 cm) diameter, it will assist in removing seals having a diameters ranging from 2 to 8 inches (5 to 20 cm) due to the adjustability offered by the elongated slots 20.

While the invention has been described with a high degree of particularity, it will be appreciated by those skilled in the art that numerous modifications and substitutions may be made thereto. For example, the number and location of the arms 14 and their corresponding slots 20 may be varied in accordance with need. Thus, in certain applications it may be desirable to utilize a seal puller having more, or less, than the four arms 14 illustrated. Further, to reduce the overall cost of invention, the nut 22 may be eliminated and replaced by threading the inner peripheral surface of the transverse bore 18 so as to threadably accept the bolt 26. Therefore, it is to be understood that the present invention is not limited to the sole embodiment described above, but encompasses any and all embodiments within the scope of the following claims.

I claim:

1. A seal puller, comprising:

a thin, flat, metallic plate including:

a planar body portion having opposed top and bottom surfaces, said planar body portion further including a threaded transverse bore having a central axis perpendicular to the top and bottom surfaces of said planar body portion; and, a plurality of arm portions extending outwardly from said planar body portion, each of said arm portions having a slot with a longitudinal axis oriented to intersect said transverse bore, each of said arm portions also having an inner end secured to said planar body portion, an outer free end spaced from said inner end, and an intermediate point located between said inner end and said outer free end, each of said arm portions further having a greater width at said intermediate point thereof than at said inner end thereof whereby the fingers of a hand of a user engaged with the opposite sides of any one of said arm portions between said inner end thereof and said intermediate point thereof will slide toward said planar body portion and foster a strong grip upon said seal puller;

a plurality of screws each being slidably engaged with a respective one of said slots, each of said screws having a head sized to prevent passage through one of said slots and being positioned atop one of said arm portions, each of said screws also having a first threaded rod portion extending from said head and through one of said slots, and each of said screws further having a gimlet point at the free end of said first threaded rod portion for penetrating a worn seal; and, a bolt threadably secured within said transverse bore, said bolt having a second threaded rod portion adapted to be extended from said bottom surface of said planar body portion.

2. A seal puller, comprising:

a body including opposed first top and bottom surfaces, said body further including a threaded transverse bore;

a plurality of arms extending outwardly from said body, each of said arms having a slot with a longitudinal axis oriented to intersect said transverse bore, each of said arms also having an inner end secured to said body, an outer free end spaced from said inner end, and an intermediate point located between said inner end and said outer free end, each of said arms further having a greater width at said intermediate point thereof than at said inner end thereof whereby the fingers of a hand of a user engaged with the opposite sides of any one of said arms between said inner end thereof and said intermediate point thereof will slide toward said body and foster a strong grip upon said seal puller;

a plurality of screws each being slidably engaged with a respective one of said slots, each of said screws having a head sized to prevent passage through one of said slots and positioned atop one of said arms, each of said screws also having a first threaded rod portion extending from said head and through one of said slots, and each of said screws further having a gimlet point at the free end of said first threaded rod portion for penetrating a worn seal; and, a bolt threadably secured within said transverse bore, said bolt having a second threaded rod portion adapted to be projected from said transverse bore beneath said bottom surface of said body.

3. The seal puller according to claim 2 wherein said arms are ovoid in outline for ease of handling by a user.

4. A seal puller, comprising:

a planar body including opposed first top and bottom surfaces being substantially flat and parallel to one another, said planar body further including a threaded transverse bore connecting said first top and bottom surfaces;

a plurality of arms extending outwardly from said planar body, each of said arms having opposed second top and bottom surfaces coextensive with said first top and bottom surfaces, each of said arms having a slot with a longitudinal axis oriented to intersect said transverse bore, each of said arms also having an inner end secured to said planar body, an outer free end spaced from said inner end, and an intermediate point located between said inner end and said outer free end, each of said arms further having an ovoid form wherein the width of each of said arms at said intermediate point thereof is greater than the width of each of said arms at said inner end thereof whereby the fingers of a hand of a user engaged with the opposite sides of any one of said arms between said inner end thereof and said intermediate point thereof will slide toward said planar body and foster strong grip upon said seal puller;

a plurality of screws each being slidably engaged with a respective one of said slots, each of said screws having a head sized to prevent passage through one of said slots and positioned atop one of said arms, each of said screws also having a first threaded rod portion extending from said head and through one of said slots, and each of said screws further having a gimlet point at the free end of said first threaded rod portion for penetrating a worn seal; and, a bolt threadably secured within said transverse bore, said bolt having a second threaded rod portion adapted to be extended from said transverse bore beneath said first bottom surface of said planar body.

* * * * *